US007594302B2

(12) United States Patent
Balenzano

(10) Patent No.: US 7,594,302 B2
(45) Date of Patent: Sep. 29, 2009

(54) PIVOT HINGE ASSEMBLY

(75) Inventor: Giuseppe Balenzano, Montreal (CA)

(73) Assignee: Les Distributions Vimac Inc., Anjou (CA)

( * ) Notice: Subject to any disclaimer, the term of this patent is extended or adjusted under 35 U.S.C. 154(b) by 0 days.

(21) Appl. No.: 12/194,985

(22) Filed: Aug. 20, 2008

(65) Prior Publication Data

US 2009/0070959 A1 Mar. 19, 2009

Related U.S. Application Data

(60) Provisional application No. 60/972,426, filed on Sep. 14, 2007.

(51) Int. Cl.
*E05D 5/02* (2006.01)

(52) U.S. Cl. ..... 16/252; 16/281

(58) Field of Classification Search ..... 16/252, 16/281, 284, 286, 379, 382, 331, 332
See application file for complete search history.

(56) References Cited

U.S. PATENT DOCUMENTS 5,079,798 A * 1/1992 Burke et al. ..... 16/252
5,297,313 A * 3/1994 Brin ..... 16/252
5,867,869 A * 2/1999 Garrett et al. ..... 16/252
6,070,294 A * 6/2000 Perkins et al. ..... 16/252
6,161,255 A * 12/2000 Garrett ..... 16/284
6,481,055 B2 * 11/2002 Cheng ..... 16/252
6,519,811 B1 * 2/2003 Cheng ..... 16/252
6,526,627 B2 * 3/2003 Chiang ..... 16/284
6,560,821 B2 * 5/2003 Miller et al. ..... 16/252
6,704,966 B1 * 3/2004 Kao ..... 16/252
7,493,673 B2 * 2/2009 Garrett ..... 16/252

FOREIGN PATENT DOCUMENTS

CA 2112794 10/1994

* cited by examiner

*Primary Examiner*—William L. Miller
(74) *Attorney, Agent, or Firm*—Goudreau Gage Dubuc

(57) ABSTRACT

There is provided a sturdy yet compact pivot hinge assembly using a preset spring and plunger assembly comprising a spring between a plunger and a spring plate, on each side of an axis, which provides, on the axis, a detent force that maintains the door closed when the door is closed and a restoring force closing the door when the door is part way open.

11 Claims, 6 Drawing Sheets

FIG. 1 (PRIORT ART)

PIVOT HINGE ASSEMBLY

CROSS REFERENCE TO RELATED APPLICATIONS

This application claims priority on U.S. provisional application Ser. No. 60/972,426, filed on Sep. 14, 2007. All documents above are incorporated herein in their entirety by reference.

FIELD OF THE INVENTION

The present invention relates to a pivot hinge assembly. More specifically, the present invention is concerned with a pivot hinge assembly for glass pane.

BACKGROUND OF THE INVENTION

A number of pivot hinge assemblies, adapted for use on glass panes of glass structures such as shower doors, for example, are known in the art. Typically, such pivot hinge assemblies are suitable for use as a top or bottom hinge for the glass door, and provide self-closing forces that tend to close the door and hold it in a closed position thereof.

FIG. 1 illustrates a shower stall generally indicated at 10. The shower stall 10 has a front bottom wall 12, front side walls 14, and a front upper wall 16, for example, extending between the side walls 14. The walls 12, 14, 16 define an opening which receives a shower door 20, pivotally mounted in the opening by a bottom hinge 22 and a top hinge 24, for example.

There is still a need in the art for pivot hinge assemblies.

SUMMARY OF THE INVENTION

More specifically, in accordance with the present invention, there is provided a hinge assembly, comprising a base adapted to be secured to a support for a pane to be hinged; a first cover and a second cover adapted to lie on each side of the pane; a block secured between said first and said second covers; the block having a flat surface flush with a flat edge of the first cover and a flat edge of the second cover, and being recessed inwardly from lateral edges and back edges of the first and the second covers respectively so as to accommodate the pane, the pane being cutout at a mounting location thereof so as to match the contour of the block; the block having a first bore extending into the block perpendicular to the flat end thereof, the block having a second bore in a first lateral edge thereof and a third bore in a second lateral edge thereof opposite the first lateral edge, each of the second and third bores extending inwardly from a respective lateral edge and intersecting the first bore; wherein the base is secured to the block by a shaft extending from the base and engaging the first bore of said block, the second and the third bores each receiving a spring pressing against a surface of the shaft thereby moving the shaft to a selected position relative to the base and providing on the shaft a detent force that maintains the pane closed in a closed position, and a restoring force closing the pane when the pane is part way open.

There is further provided a method for pivotally mounting a door pane in an opening defined by a front bottom wall, front side walls and a front upper wall, by at least one hinge, the method comprising providing a cutout at a mounting location of the pane; securing a shaft extending from a base to a first cover supporting a block by inserting the shaft into a first bore in an end surface of the block; securing a spring in each one of a second bore and a third bore, the second and third bore being provided on each side surface of the block perpendicular to the end surface of the block respectively, and intersecting the first bore; securing a second cover on a second side of the pane on top of the block opposite the first cover; and connecting the base to a mounting located on the perimeter of the door pane opening by turning the first and second covers and the base relative to each other.

There is further provided a pivot hinge assembly adapted to be clamped to a glass pane, comprising a first and a second covers adapted to lie in parallel planes on each side of the glass pane and having a pair of ends lying in a common plane, a block being provided between the first and second covers, the block having a flat end flush with ends of the first and second covers, the block having first and second lateral surfaces extending at right angles to the flat end of the block and the lateral sides of the first and second covers, the block having a main bore extending into the block perpendicular to the flat end thereof, the block having a first aperture in the first lateral surface thereof and a second aperture in the second lateral surface thereof, each of the first and second apertures extending perpendicular to its respective lateral surface and intersecting the main bore; a base having a flat end surface adapted to overlie the flat end of the block, an axis protruding from the end surface of the base and extending into the main bore, the axis having a shaft rounded in cross-section with a pair of opposed flat surface portions one extending along each side thereof; a spring being provided in each one of the first and second bores, each spring generating, on the shaft, a detent force that maintains the glass pane in a closed position, and a restoring force bringing the glass pane in the closed position when the glass pane is part open.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings:

FIG. 6 is a second exploded view of the pivot hinge assembly of FIG. 2;

DESCRIPTION OF EMBODIMENTS OF THE INVENTION

A hinge 40 as illustrated in FIGS. 2, 3 and 5-7 of the appended drawings comprises a base 42, a first cover 66 and a second cover 68.

Figure 1:
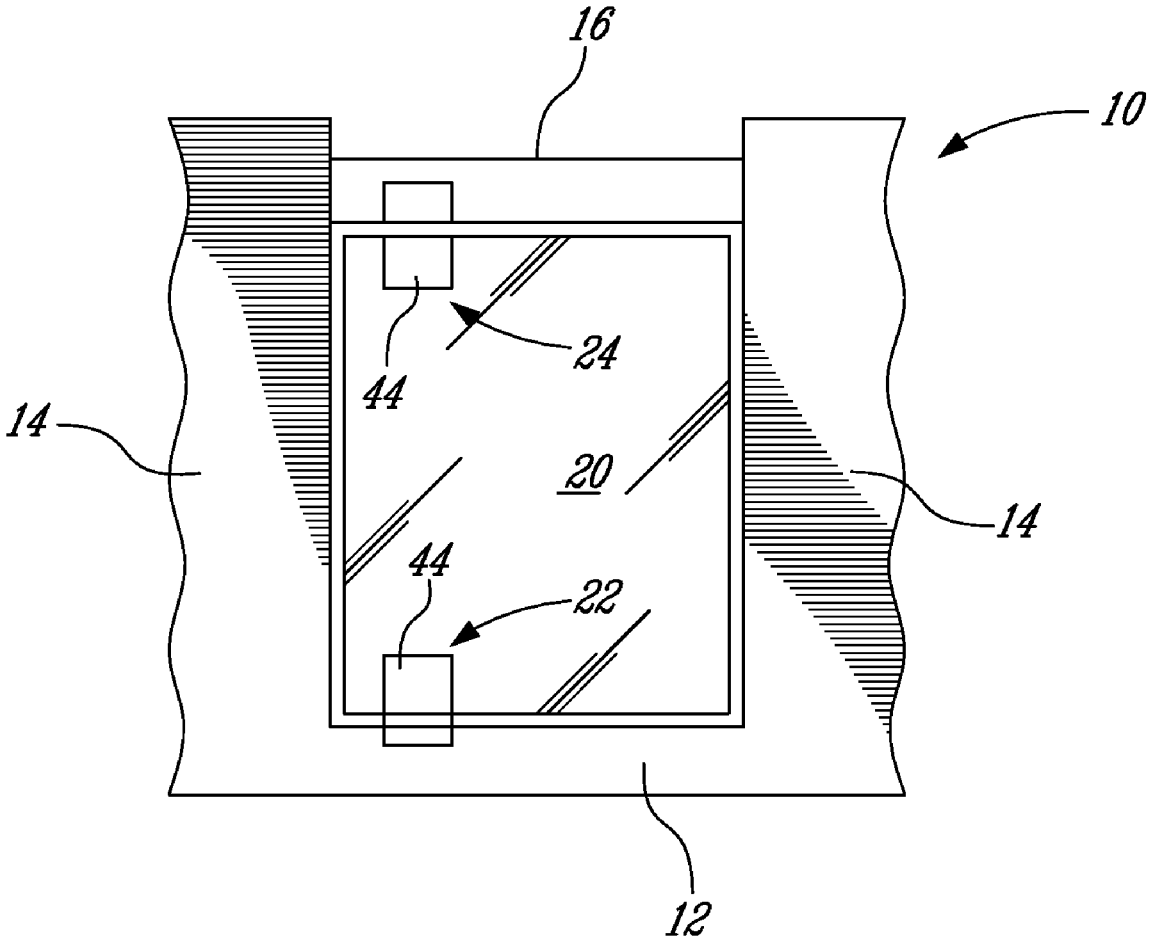
FIG. 1 illustrates a shower stall as known in the art.
Figure 2:
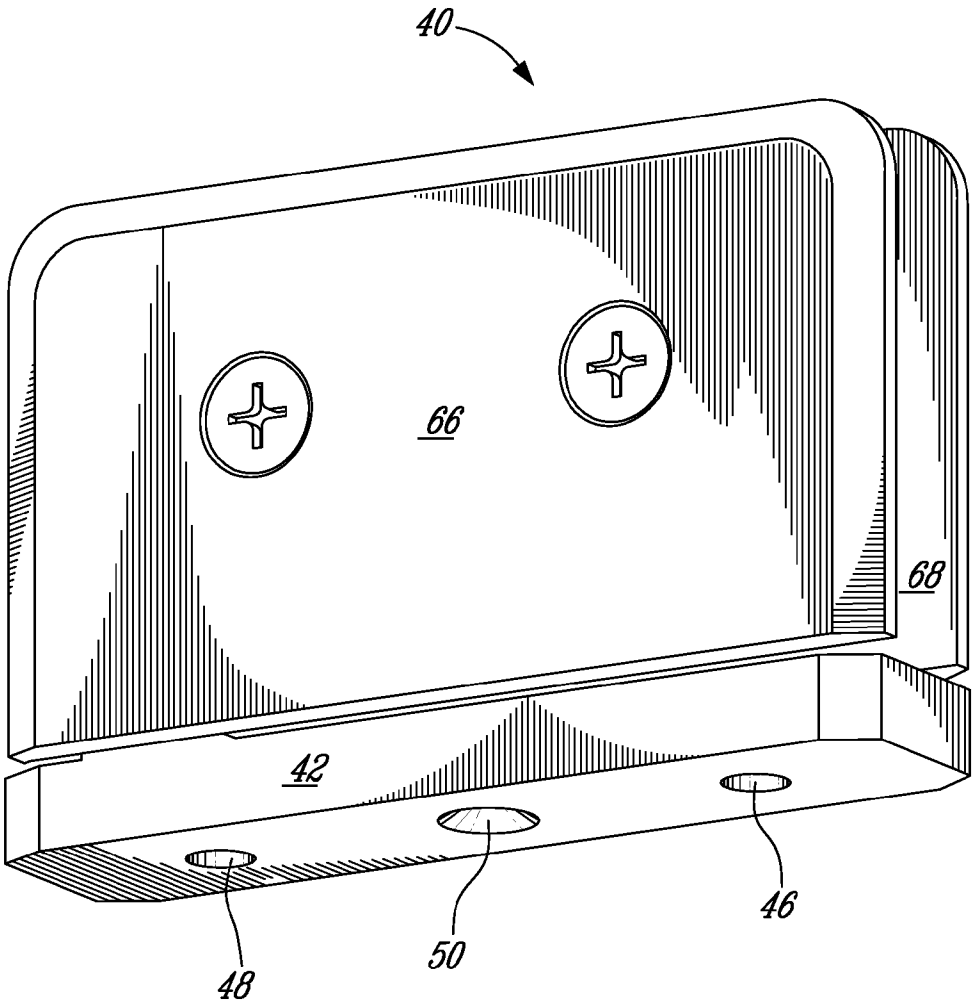
FIG. 2 is a perspective view of a pivot hinge assembly according to an embodiment of an aspect of the present invention.
Figure 3:
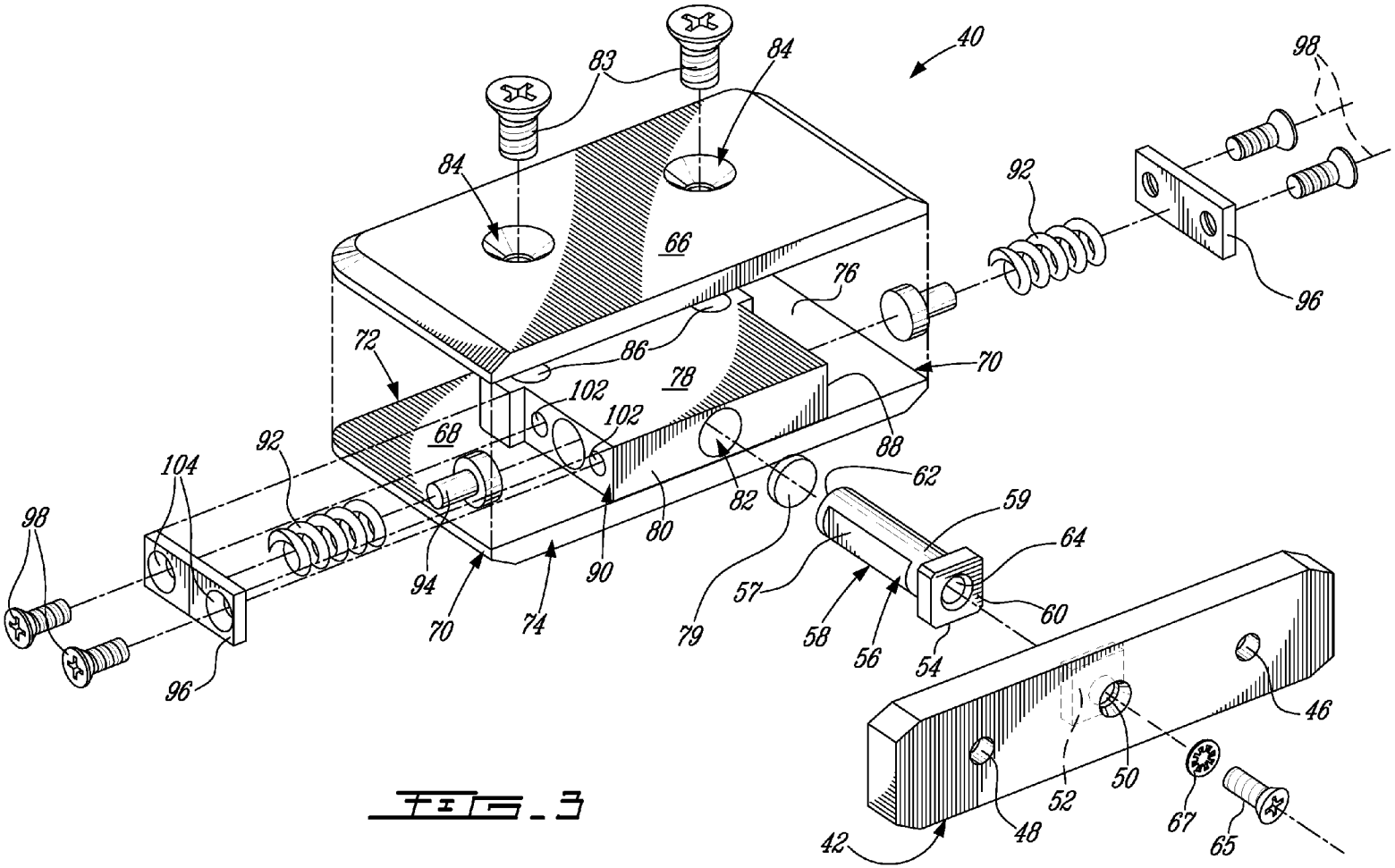
FIG. 3 is a first exploded view of the pivot hinge assembly of FIG. 2.

The base 42, best seen in FIGS. 3 and 6, is typically a flat, relatively thin rectangular member. It comprises holes 46 adapted to receive heads of screws (not shown) used, for example, to secure the base 42 to a surface on the perimeter of the aperture for a door, such as the upper surface of the bottom wall 12 of FIG. 1 for example.

A bore 52 across the thickness of the base 42 opens into a square recess 50, best seen in FIG. 3, for receiving a square head 54, for example, of an axis 56 comprising a shaft 58 extending from the square head 54 to a free end 62 thereof (see FIG. 3).

Typically, as shown in FIG. 3, for example, the shaft 58 of the axis 56 comprises an inner bore 64 extending into the square head 54, and has flat surfaces 57 on each side thereof and convex surfaces 59 on the other two sides thereof. The inner bore 64 receives a screw 65 for securing the axis 56 to the base 42 once the axis 56 is introduced into the bore 52 of the base 42, the head 54 remaining on the inner side of the base 42 (see FIG. 6). As shown in FIG. 3, a lock washer 67 may be placed underneath the head of screw 65 to prevent loosening in bore 52.

Figure 4:
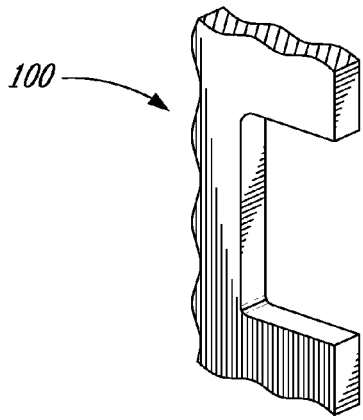
FIG. 4 illustrates a glass pane used with the pivot hinge assembly of FIGS. 2 and 3.
Figure 5:
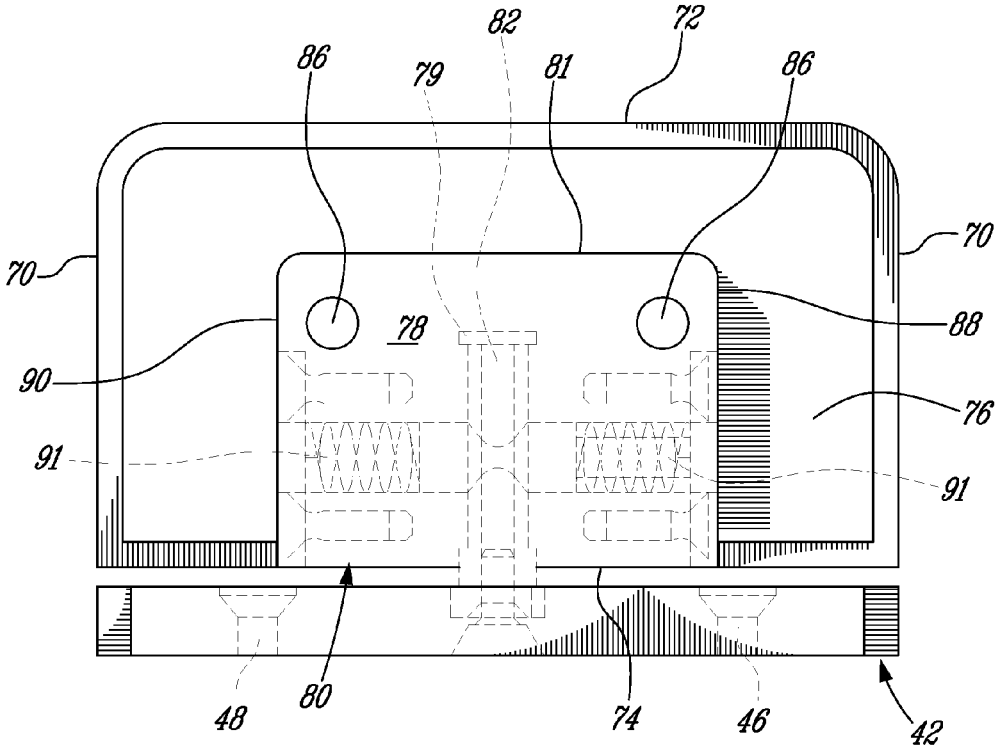
FIG. 5 shows details of the pivot hinge assembly of FIG. 2.
Figure 5:
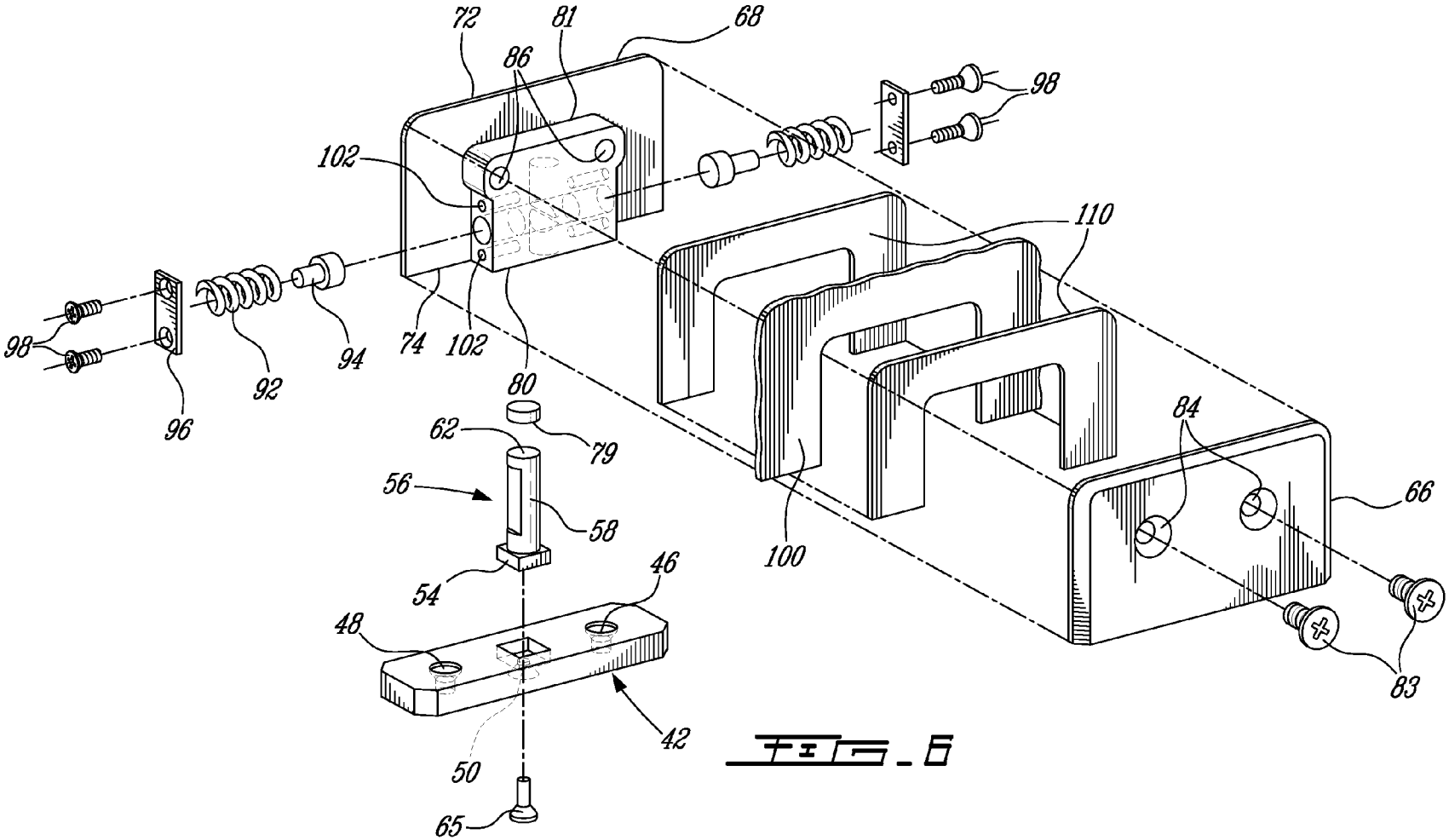
Figure 7:
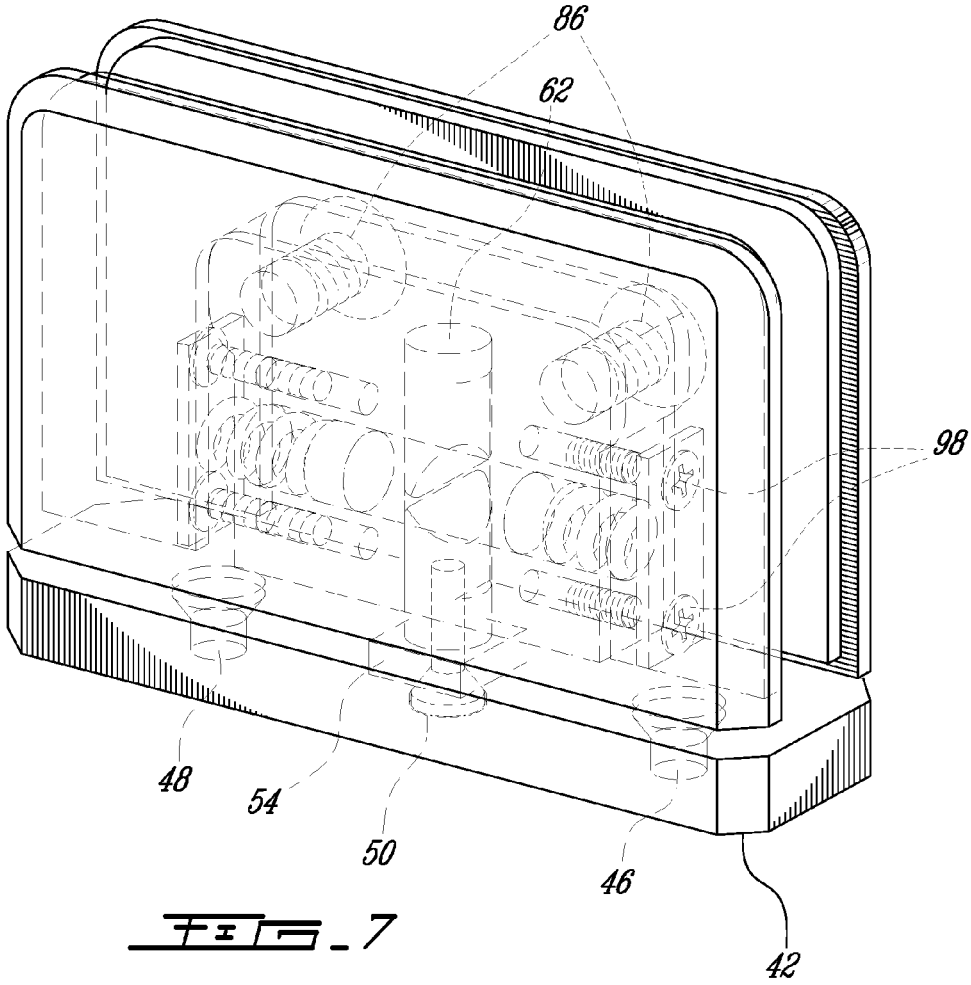
FIG. 7 shows the pivot hinge assembly of FIG. 6, assembled, in transparency.

As illustrated in FIGS. 3 and 6, for example, the first cover 66 and the second cover 68 are intended to lie on each side respectively of a glass pane 100 shown, for example, in FIG. 4 and forming part of the door or other structure to be hinged, as well known in the art. The glass pane 100 is clamped therebetween by tightening screws 83 in holes 84 of the fist cover and holes 86 described hereinbelow in relation to FIGS. 3, 5 and 6, for example.

As best seen in FIG. 3, the second cover 68 comprises lateral edges 70, a back edge 72, a flat pivot edge 74 and an inner surface 76.

A block 78 protrudes from the inner surface 76. The block 78 has flat pivot end surface 80 flush with the flat pivot edge 74, thereby forming a common flat pivot end surface, and its lateral edges 88 and 90 and back edge 81 are recessed inwardly on the inner surface 76 from the lateral edges 70 and the back edge 72 respectively of the second cover 68.

The block 78 comprises a bore 82 extending thereinto from the end surface 80 thereof. The bore 82 may terminate inside the block 78 at a distance from the back edge 81 of the block 78 opposite the end surface 80 thereof (See FIGS. 5 and 6).

As best seen in FIGS. 4 and 6, the glass pane 100 has a cutout corresponding to the contour of the block 78, so that the block 78 can be inserted in the glass cutout for assembly as will be described hereinbelow.

Thus, as well known in the art, the second cover 68 may be positioned on a first side of the glass pane 100 with the block 78 accommodated into the shape of the glass pane 100, while the first cover 66 may be positioned on a second side of the glass pane 100. As will be described hereinbelow in relation to FIG. 6, the glass pane 100 may be sandwiched between gaskets 110.

As best seen in FIG. 3, the first cover 66 may be secured on the second side of the glass pane by screws 83 received in holes 84 of the first cover 66 and into communicating threaded holes 86 of the block 78, positioned on each side of the bore 82 of the block 78, for example.

The two lateral edges 88 and 90 of the block 78 thus extend between the first cover 66 and the second cover 68, generally parallel to the bore 82 of the block 78, and perpendicularly to the end surface 80 of the block 78.

The lateral edge 90 of the block 78 comprises an aperture 91 extending into the block 78 parallel to the surface 80 of the block 78. Similarly, an aperture 91 is provided on the lateral face 88 of the block 78. A single aperture 91 may be contemplated, extending from the side face 88 to the face 90 of the block 78. These apertures 91 are aligned one relative to the other, and intersect the bore 82 of the block 78 (see FIG. 5).

When the base 42 is secured to the second cover 68, the axis 56 of the base 42 (see FIG. 3) extends into the bore 82 of the block 78. As known in the art, metal to metal contact may be prevented by providing a cushioning pad 79, such as a graphite pad covered with lubricant for example, between the surface of the shaft 58 and the inner surface of the bore 82 inside the block 78.

By using an axis with a square head 54 and an outer screw 65 as described hereinabove in relation to FIG. 6, the shaft 58 may be inserted into the second cover 68 before or after the shaft 58 is connected to the base 42.

When the shaft 58 is inserted into the second cover 68, a compression spring 92 is housed in each aperture 91 of the lateral edges 88 and 90 of the block 78, between a plunger 94 and a spring plate 96 as shown in F*igure* 3. Each spring plate 96 is held in position on the respective lateral edges 88, 90 using screws 98 received through holes 104 in the spring plates 96 into threaded bores 102 on each side of the aperture 91, for example (see FIGS. 3, 6). The size of the plate may vary, as long as it covers sufficiently the mouth of the bore 91 so as to retain the spring 92 therein.

On each side of the shaft 58, a compression spring 92 presses the head of a plunger 94 against surfaces of the shaft 58, thereby maintaining the shaft 58 into the bore 82, and further maintaining it in place in the closed position of the door, as will be described hereinbelow. The springs 92 are selected relatively large and strong, so as to exert a pressure generating a detent and self-closing force against the shaft 58.

For installation on a door, the shaft 58 of the base 42 is first inserted into the bore 82 of the block 78. Then a spring 92 and a plunger 94 assembly is inserted into the aperture 91 of each one of the two lateral edges 88 and 90 of the block 78, and secured in place by a spring plate 96 as discussed hereinabove.

The plunger 94 contributes to maintaining the shaft 58 in the bore 82 of the block 78.

Pressure is submitted on flat surfaces 57 of the shaft 58 by the head of the plungers 94 via the compression springs 92.

Figure 8:
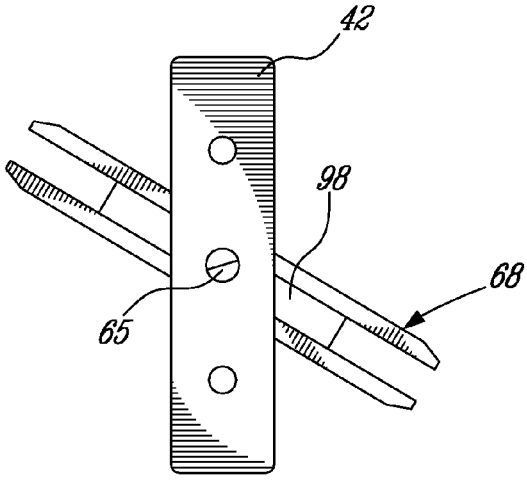
FIG. 8 shows the covers and the base rotated relative to each other.

Then the cover 66 may be mounted on top of the block 78 as described hereinabove. The assembly of the first and second covers 66, 68 is turned relative to the base 42 to expose screw holes 46 and 48 of the base 42 (FIG. 8) to allow connecting the base 42 to the top surface of bottom wall 12 using the screw holes 46 and 48 of the base 42 (see FIG. 3) as described hereinabove.

When the door is more than half way open, since the spring and plunger assembly on each side of the shaft 58 presses on the convex surfaces 59 of the shaft 58, the door stays open.

Typically, the hinge assembly is made in brass, for example, and the spring in stainless steel for resistance to corrosion.

Gaskets 110, made in rubber or vinyl, for example, may be accommodated between the first cover 66 and the second cover 68, around the block 78 to separate the metallic material of the hinge assembly from the material of the glass door to be hinged, as shown in FIG. 6.

From the foregoing, people in the art will now be in a position to appreciate that there is provided a sturdy yet compact pivot hinge assembly using a preset spring and plunger assembly comprising a spring between a plunger and a spring plate, on each side of the shaft 58, which provides, on the shaft 58, a detent force that maintains the door closed when the door is closed and a restoring force closing the door when the door is part way open.

There is therefore provided a pivot hinge assembly adapted to be clamped to a glass pane, comprising a base, a first and second covers adapted to lie in parallel planes one on each side of the glass pane and having a pair of ends lying in a common plane, a block being provided between the first and second covers, the block having a flat end flush with ends of the first and second covers, the block having first and second side surfaces extending at right angles to the flat end of the block and the ends of the first and second covers, the block having a main bore extending into the block perpendicular to the flat end thereof, the block having a bore in the first side surface thereof and a second bore in the second side surface thereof, each of the first and second bores extending perpendicular to its respective side surface and intersecting the main bore; the base having a flat end surface adapted to overlie the flat end of the block, an axis connected to and protruding from the end surface of the base and extending into the main bore, said axis being rounded in cross-section with a pair of opposed flat surface portions one extending along each side thereof; a preset spring and plunger assembly being provided in each one of the first and second bores of the block, the spring and plunger assembly comprising a spring between a plunger and a spring plate, on each side of the main bore of the block receiving the axis, to generate, on the axis, a detent force that maintains the door closed when the door is closed and a restoring force closing the door when the door is part open.

Although the present invention has been described hereinabove by way of embodiments thereof, it may be modified, without departing from the nature and teachings of the subject invention as described herein.

The invention claimed is:

1. A hinge assembly, comprising:

a base adapted to be secured to a support for a pane to be hinged;

a first cover and a second cover, said first and said second covers being adapted to lie on each side of said pane;

a block, said block being secured between said first and said second covers; said block having a flat surface flush with a flat edge of said first cover and a flat edge of said second cover; said block being recessed inwardly from lateral edges and back edges of said first and said second covers respectively so as to accommodate the pane, the pane being cutout at a mounting location thereof so as to match the contour of the block; the block having a first bore extending into said block perpendicular to said flat end thereof, each lateral edge of the block being provided with a single bore, including a second bore in a first lateral edge thereof and a third bore in a second lateral edge thereof opposite said first lateral edge, each of said second and third bores extending inwardly from a respective lateral edge and intersecting said first bore;

wherein said base is secured to said block by a shaft extending from said base and engaging said first bore of said block, said second and said third bores each receiving a spring, said spring pressing against a surface of said shaft extending in said first bore thereby moving said shaft to a selected position relative to said base and providing on said shaft a detent force that maintains the pane closed in a closed position, and a restoring force closing the pane when the pane is part way open.

2. The hinge assembly of claim 1, wherein said base supports said shaft in alignment with said first bore of said block.

3. The hinge assembly of claim 1, wherein said shaft comprises flat surfaces on first two opposite sides thereof and convex surfaces on second two opposite sides thereof.

4. The hinge assembly of claim 1, wherein said block protrudes from an inner surface of said second cover, and said first cover is adapted to be positioned and secured on top of said block.

5. The hinge assembly of claim 1, wherein said second and third bores are aligned relative to the other on each side of said first bore.

6. The hinge assembly of claim 1, wherein said second and third bores form a single bore extending across a length of the block.

7. The hinge assembly of claim 1, wherein, in each one of said second and third bores, said spring is retained by a plate covering a mouth of the second and third bores respectively.

8. The hinge assembly of claim 1, further comprising gaskets, said pane being sandwiched between said gaskets.

9. A method for pivotally mounting a door pane in an opening defined by a front bottom wall, front side walls and a front upper wall, by at least one hinge, comprising:

providing a cutout at a mounting location of the pane;

securing a shaft extending from a base to a first cover supporting a block by inserting the shaft into a first bore in an end surface of the block, the block having a first side surface provided with a second single bore and a second side surface, opposite the first side surface, provided with a third single bore; the second and third bores being provided on each side surface of the block perpendicular to the end surface of the block respectively, and intersecting the first bore;

securing a spring in each one of the second bore and the third bore;

securing a second cover on a second side of the pane on top of the block opposite the first cover; and connecting the base to a mounting located on the perimeter of the door pane opening by turning the first and second covers and the base relative to each other.

10. The method of claim 9, wherein said securing a spring in each one of the second bore and the third bore comprises locating the spring in the corresponding bore and retaining the spring therein by a plate located at the mouth of the respective bore.

11. A pivot hinge assembly adapted to be clamped to a glass pane, comprising:

a first and a second covers adapted to lie in parallel planes on each side of the glass pane and having a pair of ends lying in a common plane, a block being provided between the first and second covers, the block having a flat end flush with ends of the first and second covers, the block having first and second lateral surfaces extending at right angles to the flat end of the block and the lateral sides of the first and second covers, the block having a main bore extending into the block perpendicular to the flat end thereof, each lateral surface of the block being provided with a single aperture, including a first aperture in the first lateral surface thereof and a second aperture in the second lateral surface thereof, each of the first and second apertures extending perpendicular to its respective lateral surface and intersecting the main bore;

a base, said base having a flat end surface adapted to overlie the flat end of the block, an axis protruding from the end surface of the base and extending into the main bore, said axis having a shaft rounded in cross-section with a pair of opposed flat surface portions one extending along each side thereof;

a spring being provided in each one of the first and second bores, each spring generating, on the shaft, a detent force that maintains the glass pane in a closed position, and a restoring force bringing the glass pane in the closed position when the glass pane is part open.

* * * * *